US005341733A

United States Patent [19]

Weisbrod

[11] Patent Number: 5,341,733

[45] Date of Patent: Aug. 30, 1994

[54] SHORT INKING APPARATUS FOR A ROTARY PRESS

[75] Inventor: Norbert G. Weisbrod, Hessheim, Fed. Rep. of Germany

[73] Assignee: Albert Frankenthal Aktiengesellschaft, Wurzburg, Fed. Rep. of Germany

[21] Appl. No.: 924,048

[22] PCT Filed: Feb. 27, 1991

[86] PCT No.: PCT/DE91/00158

§ 371 Date: Sep. 2, 1992

§ 102(e) Date: Sep. 2, 1992

[87] PCT Pub. No.: WO91/13761

PCT Pub. Date: Sep. 19, 1991

[30] Foreign Application Priority Data

Mar. 3, 1990 [DE] Fed. Rep. of Germany ..... 4006720
Mar. 22, 1990 [DE] Fed. Rep. of Germany ..... 4009254
Jan. 23, 1991 [DE] Fed. Rep. of Germany ..... 4101797

[51] Int. Cl.[5] ..... B41F 7/26; B41F 31/00; B41L 27/04

[52] U.S. Cl. ..... 101/148; 101/350

[58] Field of Search ..... 101/148, 147, 349, 350, 101/351, 352, 207–210, 363, 364

[56] References Cited

U.S. PATENT DOCUMENTS 3,705,451 12/1972 Dahlgren ..... 101/148
4,584,940 4/1986 Germann et al. ..... 101/148
4,619,198 10/1986 Moll ..... 101/350
4,753,165 6/1988 Grosshauser ..... 101/350
5,003,871 4/1991 Franz et al. ..... 101/148

FOREIGN PATENT DOCUMENTS 58-220748 4/1984 Japan .

OTHER PUBLICATIONS

Deutscher Drucker; No. 25, Dec. 14, 1989; Ostfildern "Die Annilox-Druckeinheit Von Man Roland".

*Primary Examiner*—J. Reed Fisher
*Attorney, Agent, or Firm*—Jones, Tullar & Cooper

[57] ABSTRACT

A short inking unit for an offset rotary printing unit that has a dampening fluid system includes at least a first additional pair of rollers. A first roller of this first additional roller pair contacts a forme cylinder and a second roller of this first additional roller pair engages the ink forme cylinder. Second and third additional roller pairs may be used. Each additional roller pair is positioned either on the dampening system side of the printing unit or on the side of the printing unit opposite the dampening system.

5 Claims, 5 Drawing Sheets

SHORT INKING APPARATUS FOR A ROTARY PRESS

FIELD OF THE INVENTION

The invention relates to a short inking system for an offset rotary printing press with a screen roller.

DESCRIPTION OF THE PRIOR ART

A short inking system and printing system for an offset web-fed rotary printing press has been made public through the article "Die Anilox-Druckeinheit von MAN-Roland" (The Anilox Printing Unit of MAN-Roland) in the journal "DEUTSCHER DRUCKER" (The German Printer), No. 52, Vol. 25, Dec. 14, 1989, pp. W28 to W29. The ink application roller, the printing, rubber, and counterpressure rollers are embodied as double circumference cylinders or rollers. They have the same effective diameter (=same diameter), i.e. their circumferential speeds when printing are the same. A screen roller conveys ink from a chambered doctor blade system to an ink application roller. The diameter of the screen roller is less than that of the ink application roller.

SUMMARY OF THE INVENTION

It is the object of the invention to provide a short inking system with a screened ink application roller, plate and rubber cylinder, which all have the same circumference, for a web-fed rotary printing press, the dampening water consumption of which during the printing process is considerably reduced in comparison with the state of the art.

The advantages which can be achieved by means of the invention consist particularly in that the dampening water consumption during printing is reduced up to 50%. There is no scumming in spite of the small dampening water consumption. The printing ink is emulsified considerably less with dampening water, which results in a more brilliant printed image, particularly with multi-color printing.

BRIEF DESCRIPTION OF THE DRAWINGS

An exemplary embodiment of the invention is shown in the drawings and will be explained in detail below.

Shown are in.

DESCRIPTION OF PREFERRED EMBODIMENTS

Figure 1:
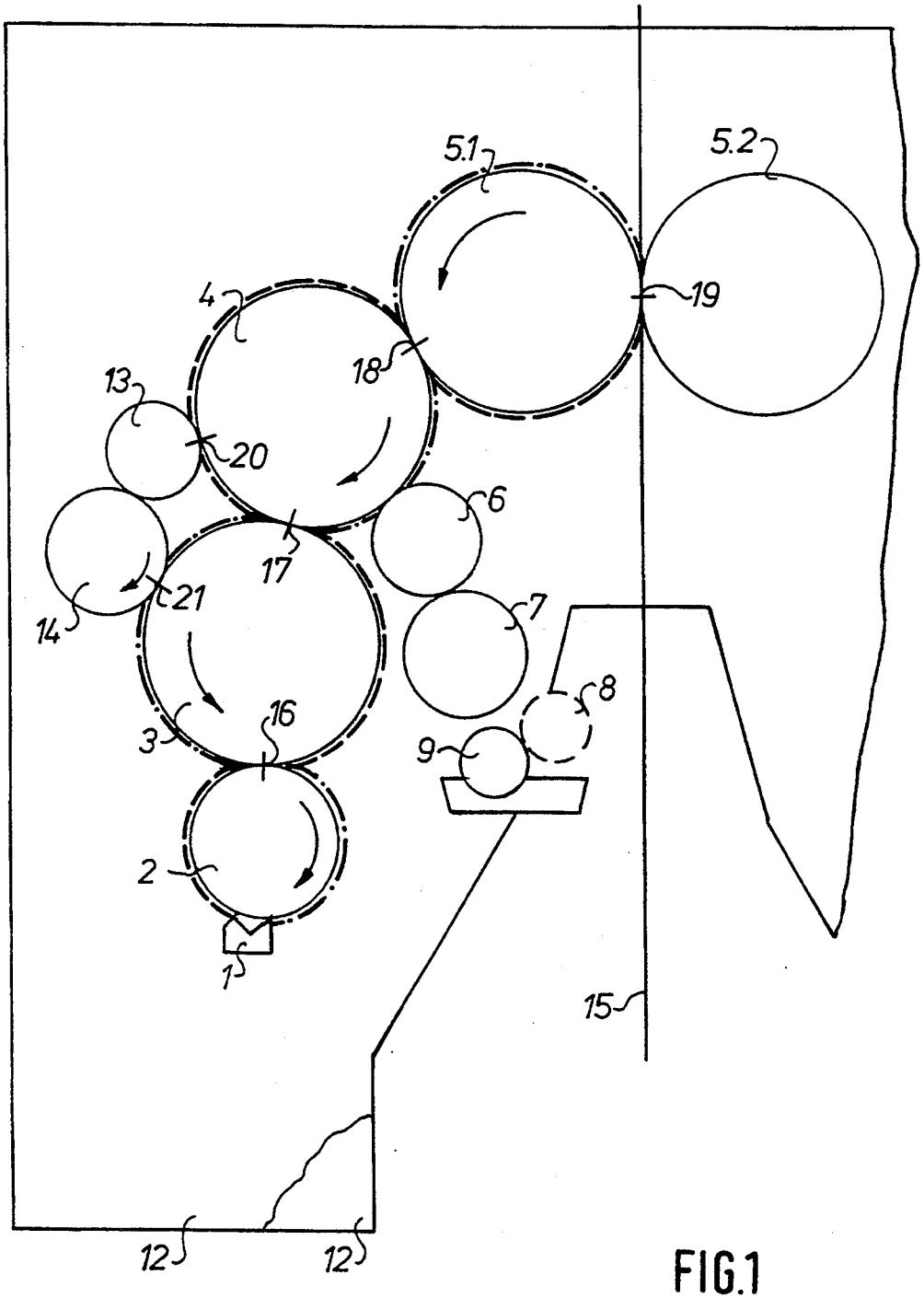
FIG. 1 a schematic view of the short inking system of the invention.

In a known manner, an ink supply in the form of a chambered doctor blade 1, a screen roller 2, an ink application cylinder 3, a printing or forme cylinder 4, a first rubber blanket cylinder 5.1, and a second rubber blanket cylinder 5.2, are seated in lateral frames 12. The ink application cylinder 3, the printing cylinder 4, the rubber blanket cylinder 5.1, the rubber blanket cylinder 5.2, which also acts as counterpressure cylinder, have the same effective circumference or diameter. Preferably they are embodied as so-called double circumference cylinders or rollers. A dampening system, preferably a brush dampening system, which delivers an amount of dampening medium to the ink application cylinder 3 is disposed to the right of the ink application cylinder 3. The brush dampening system consists of a brush roller 8, a dampening medium box roller 9, a dampening friction cylinder 7 and a dampening medium application roller 6, which conveys the dampening medium to a printing cylinder 4. A paper web 15 is printed between the rubber blanket cylinders 5.1 and 5.2.

Two additional rollers 13 and 14 are seated in the lateral frames 12 or in a pivotable frame on the left side of the inking system which is opposite the dampening system. The pivotable frame is seated in such a way that it can put the roller 13 out of contact with the printing or forme cylinder 4. The rollers 13, 14 remain in contact with the ink application cylinder 3 when the roller 13, together with the ink application cylinder 3, is displaced from the printing cylinder 4. The ink application cylinder 3 and the roller 13 are together placed against or displaced from the printing cylinder 4.

The rollers 13, 14 rotate against each other under pressure, without individual drives. The roller 13 is provided with an oleophilic rubber cover and performs a back-and-forth movement in the direction of its longitudinal axis. During the printing operation it is placed against the printing cylinder 4. The roller 14 is provided with an oleophilic cover, for example a polyamide cover, and performs a back-and-forth movement in the direction of its longitudinal axis. This oleophilic cover of the roller 14 conveys a printing ink layer which has been moistened on the outside with a very finely dispersed surface dampening medium, for example water and/or has in its interior printing ink emulsified with the dampening means. It is also possible for the roller 14 to be provided with a cover of a hydrophilic material, for example chromium, for the return of surface dampening medium to the printing plate of the printing cylinder or for reducing the flow of dampening means to the screen roller 2 and thus into the ink supply. However, it can also rotate without the back-and-forth movement. Drives for generating the back-and-forth movement are known and are not a subject of the invention.

A "fresh" flow of ink (=———) moves on each of the cylinder surfaces ahead of the chambered doctor blade 1 along the left half of the screen roller 2 as far as the tangent line 16 of the screen roller 2 with the ink application cylinder 3, along the right half of the ink application cylinder 3 as far as the tangent line 17 of the ink application cylinder 3 with the printing cylinder 4, along the left half of the printing cylinder 4 as far as the tangent line 18 of the print cylinder 4 with the rubber blanket cylinder 5.1, then along the right half of the rubber blanket cylinder 5.1 as far as the point of printing 19. From the point of printing 19 the "used-up" flow of ink (=return ink flow =———,———) moves along the left half of the rubber blanket cylinder 5.1. as far as the tangent line 18, the right half of the printing cylinder 4 as far as the tangent line 17, then along the left half of the ink application rollers 3 as far as the tangent line 16 and from it finally along the right half of the screen roller 2 to the chambered doctor blade 1.

Figure 2:
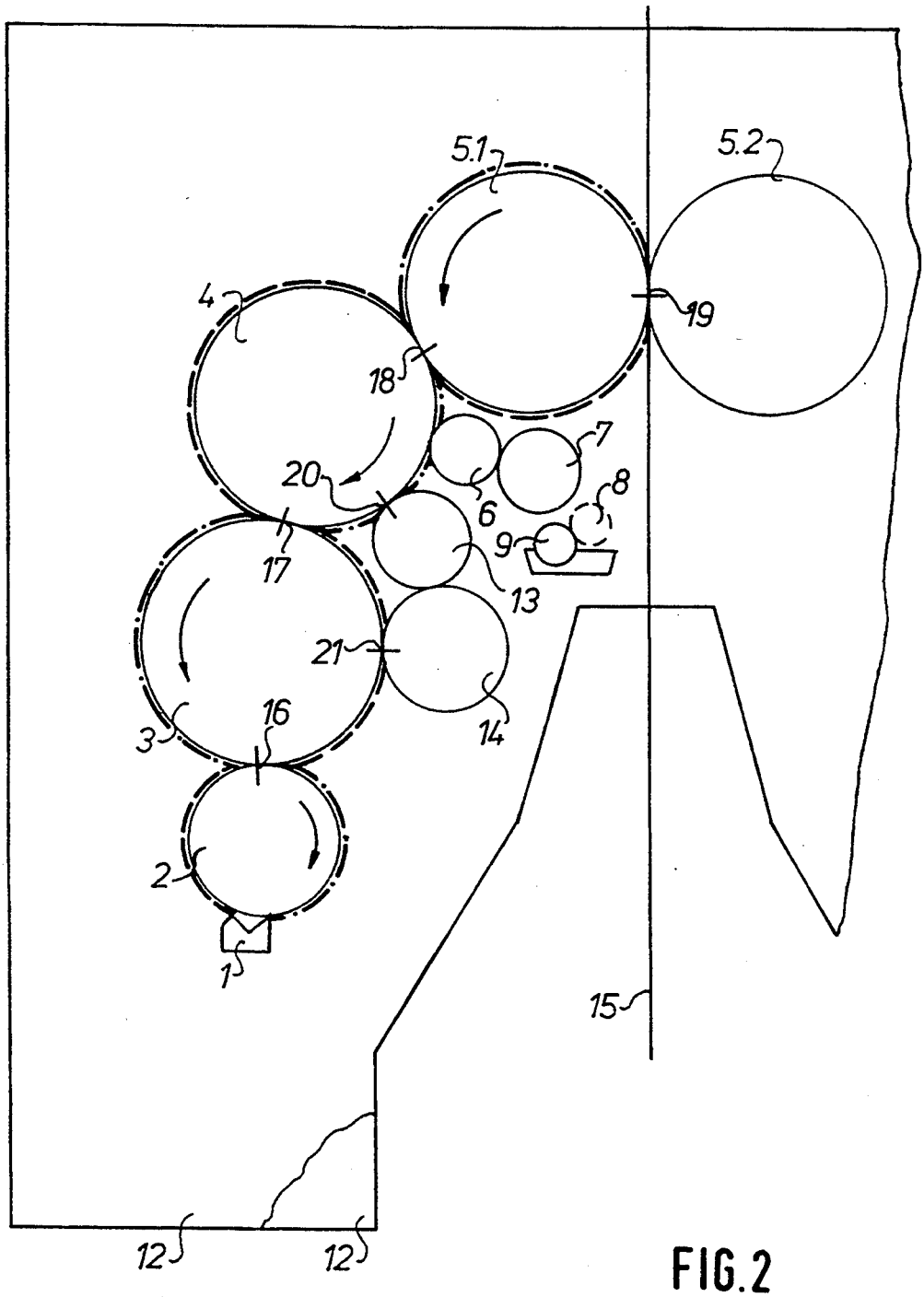
FIG. 2 a second exemplary embodiment of the short inking system of the invention, FIG. 3 a third exemplary embodiment of the short inking system of the invention, FIG. 4 a fourth exemplary embodiment of the short inking system of the invention, FIG. 5 a fifth exemplary embodiment of the short inking system of the invention.

In a further attainment of the object, however, as seen in FIG. 2, the rollers 13 and 14 can also be mounted on the right side, the side on which the dampening system is disposed. In this case the dampening means application roller 6 and the first roller 13 are in rolling contact with the same shell half of the printing cylinder 4, i.e. the first roller 13 is in contact with that part of the printing cylinder 4 on which the "used-up" flow of ink returns back to the chambered doctor blade 1 (return ink flow). Of course the second roller 14 then is disposed on the right side of the ink application roller 3 and is in rolling contact with it and the first roller 13.

Whatever has been stated about the pivotability of the rollers 13, 14 in connection with the first attainment, also holds true in connection with the further attainments.

The roller 13 in each instance has been placed against the printing cylinder 4 under pressure—by the way, so are the remaining rollers and cylinders—and with it forms a tangent line 20. This tangent line 20 is located in the flow of "fresh ink", i.e. on the circumference of the left half of the printing cylinder 4, or in the flow of the "used-up" ink on the right half of the printing cylinder 4. The roller 14 and the ink application cylinder 3 are placed against each other under pressure and form a tangent line 21. This tangent line 21 is located, depending on the disposition of the roller 13, in the "return" ink flow, i.e. on the circumference of the left half of the ink application roller 3 (FIG. 1), or in the "fresh" flow of ink on the right half of the ink application roller 3 (FIG. 2). For reasons of simplification the term tangent lines 16, 17, 18, 20, 21 is used. Strictly speaking, however, they are not lines, but narrow surfaces in the longitudinal direction of the axes of the rollers or cylinders.

Figure 3:
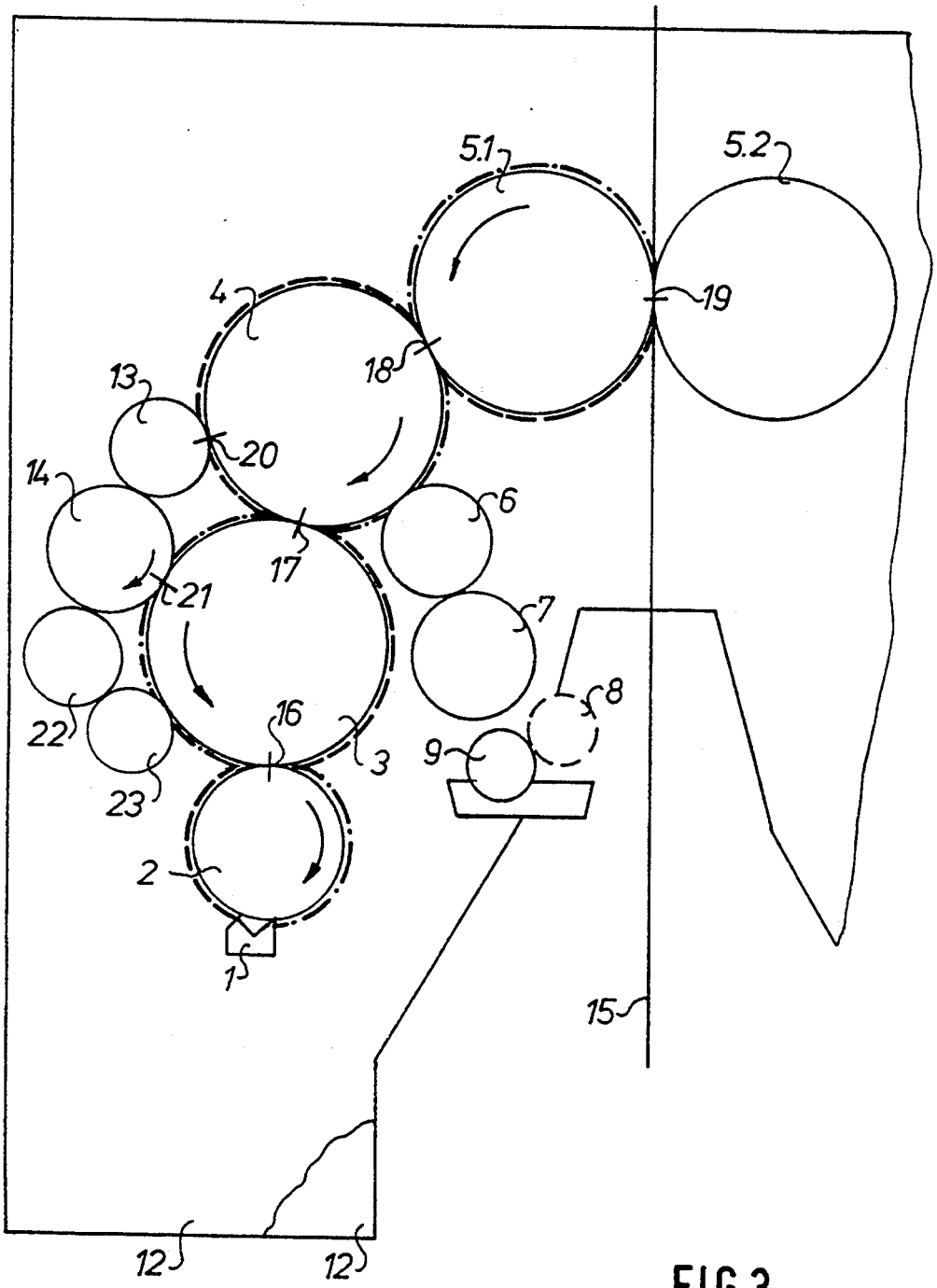
Figure 4:
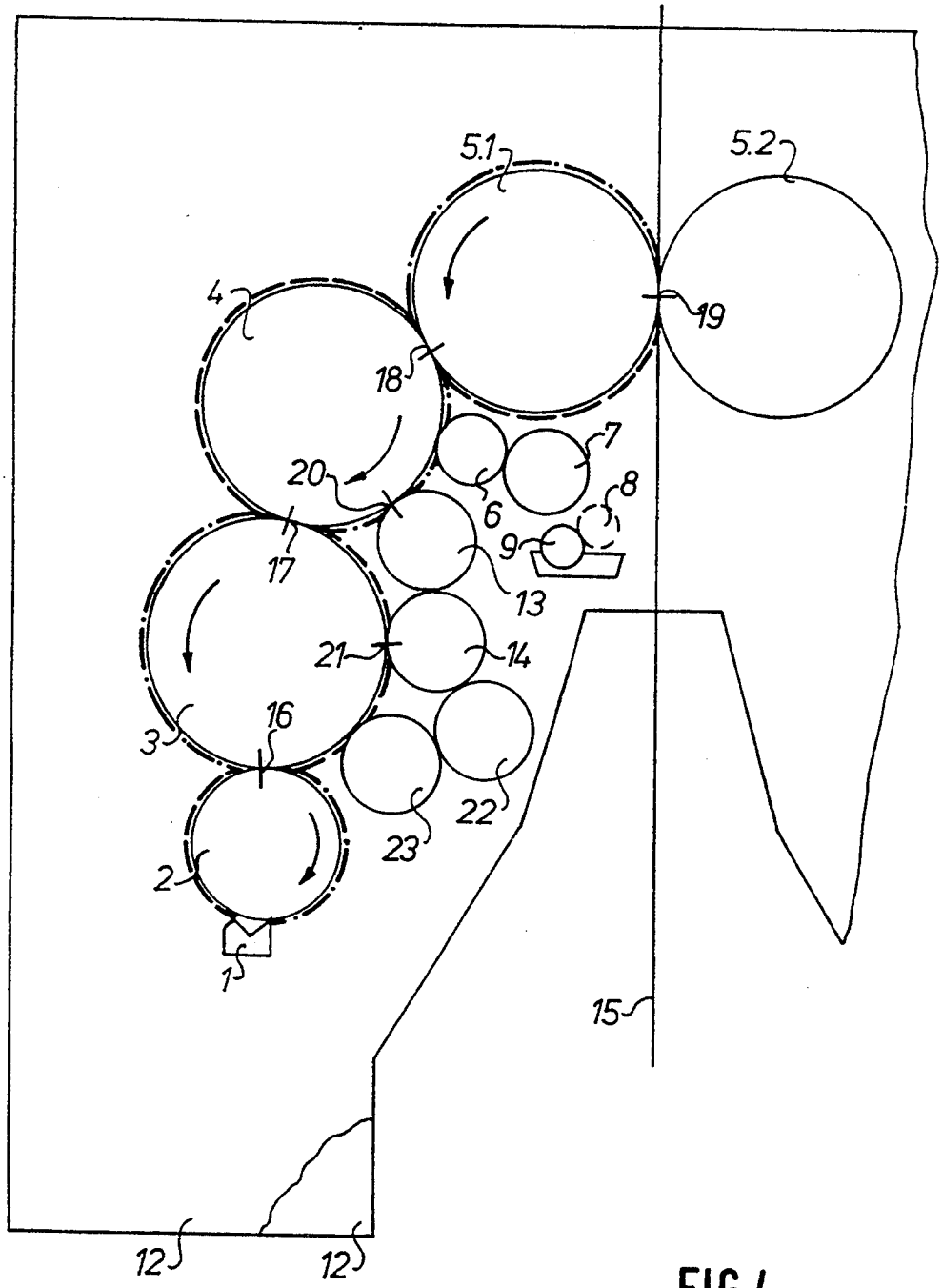

In the exemplary embodiments in accordance with FIG. 3 and FIG. 4, a roller 22 with an oleophilic cover of, for example, rubber, and a further roller 23 with an oleophilic cover, for example of polyamide, are disposed in addition to the embodiments in accordance with FIG. 1 and FIG. 2. The roller 23 can be connected with a drive known per se, so that it performs a back-and-forth movement in the direction of the longitudinal axis via toothed wheels.

The roller 22 rotates under pressure with the roller 14, the roller 23 rotates under pressure with the roller 22 and with the ink application cylinder 3 and are driven by friction. The rollers 22 and 23 may have an individual drive.

Therefore the roller 23 one time is located in the "used-up" ink flow (FIG. 3) or another time in the "fresh" ink flow (FIG. 4) on the ink application roller 3.

Figure 5:
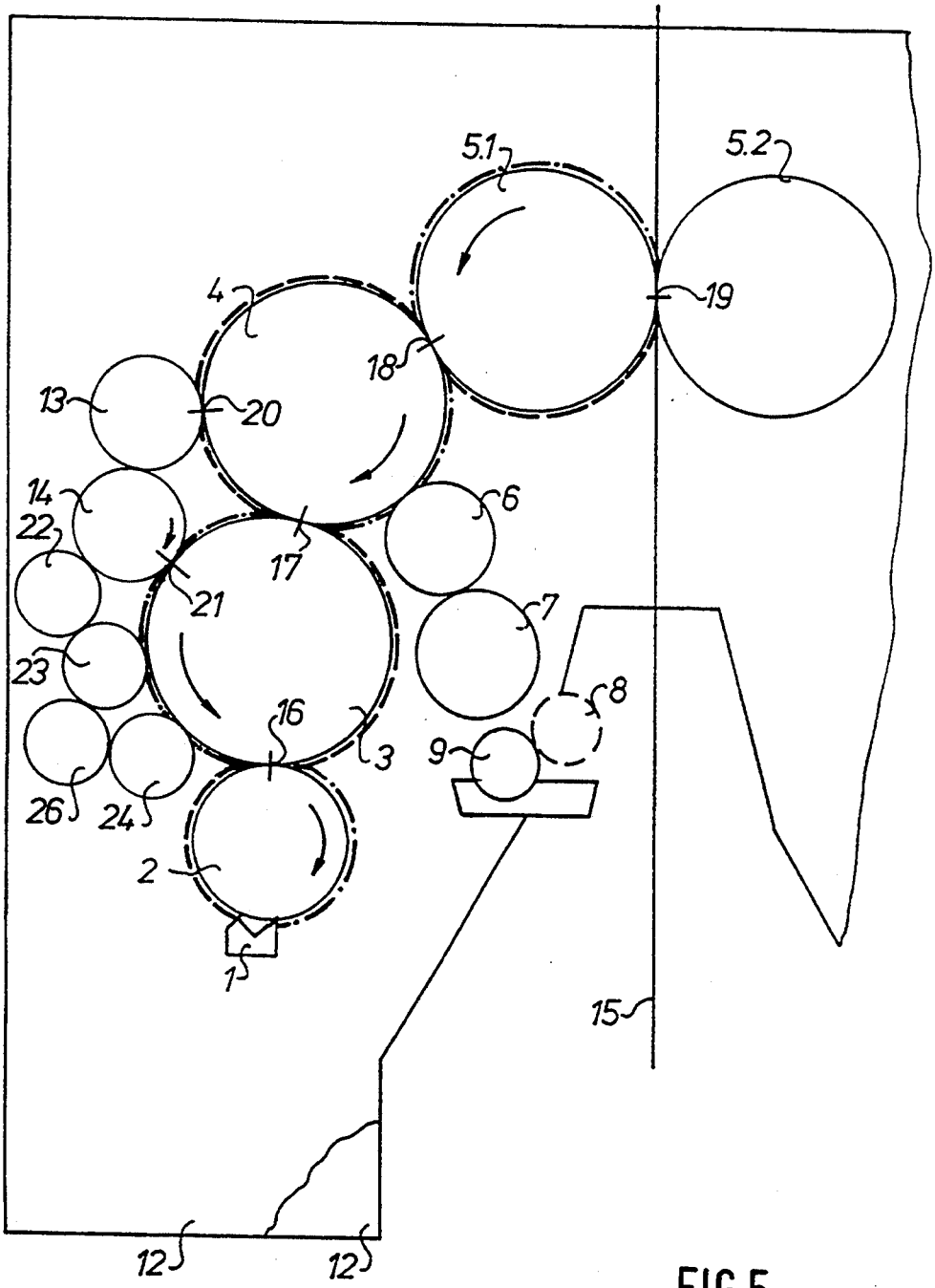

As illustrated in FIG. 5, further, for example two or more, pairs of rollers 24, 26, each with an oleophilic cover, can be provided. A first roller 24 which is the cylinder contact roller of the pair(s) of rollers in each case is in rolling contact with the ink application cylinder 3 and the second roller which is the bridging roller of the pair of rollers 24, 26. In each case the bridging roller 26 is in rolling contact with the roller 23 immediately adjacent to it—looking in the direction of the printing cylinder 4—, which is in direct rolling contact with the ink application cylinder 3.

The pair(s) of rollers 24, 26 can also be in rolling contact with the ink application cylinder 3 in the "fresh" flow of ink, namely if the rollers 13, 14; 22, 23 are disposed as described in FIG. 4.

The rollers 24, 26 can have a drive for their back-and-forth movement in the direction of the longitudinal axis.

The rollers 13, 14, 22, 23, 24, 26 can have the same or different diameters in respect to each other.

I claim:

1. A short inking unit for an offset rotary printing press comprising:

a printing unit having a single screened surface ink roller, means to supply ink to said ink roller, a single ink application cylinder in direct contact with said ink roller, a single forme cylinder in direct contact with said ink application cylinder and a single blanket cylinder in direct contact with said forme cylinder and with a web to be printed, said ink application cylinder, forme cylinder, and blanket cylinder all having the same diameter;

a dampening fluid system on a first side of said printing unit and in contact with said forme cylinder; and a first additional pair of rollers having a first roller having a rubber jacket and being in contact with said forme cylinder of said printing unit and a second roller of said first additional pair of rollers having a jacket, said second roller being in contact with said ink application cylinder and said first roller of said first additional pair of rollers.

2. The short inking unit of claim 1 wherein said first roller of said first additional pair of rollers is mounted for pivotable movement away from said forme cylinder.

3. The short inking unit of claim 1 wherein said first additional pair of rollers is located on a second side of said printing unit and opposite said dampening system.

4. The short inking unit of claim 1 wherein said jacket of said second roller of said first additional pair of rollers is oleophilic.

5. The short inking unit of claim 1 wherein said jacket of said second roller of said first additional pair of rollers is hydrophilic.

* * * * *